US005160081A

United States Patent [19]

Beales

[11] Patent Number: 5,160,081

[45] Date of Patent: Nov. 3, 1992

[54] LOCKING TRAYS

[75] Inventor: Jonathan T. Beales, Memphis, Tenn.

[73] Assignee: International Paper Company, Purchase, N.Y.

[21] Appl. No.: 813,734

[22] Filed: Dec. 27, 1991

[51] Int. Cl.[5] ..... B65D 43/02

[52] U.S. Cl. ..... 229/114; 229/175.27; 229/125.29; 229/901

[58] Field of Search ..... 229/113, 114, 125.26, 229/125.27, 125.29, 901, 125.28

[56] References Cited

U.S. PATENT DOCUMENTS

| | | | |
|---|---|---|---|
| 1,004,791 | 10/1911 | Johnson | 229/120.05 |
| 2,284,959 | 6/1942 | Guyer et al. | 229/171 |
| 2,493,338 | 1/1950 | Buttery | 229/117.03 |
| 2,544,565 | 3/1951 | Phillips | 229/145 |
| 2,551,324 | 5/1951 | Frieders | 229/145 |
| 2,623,684 | 12/1952 | Collura | 229/117.07 |
| 2,744,676 | 5/1956 | Sealy | 229/146 |
| 2,848,152 | 8/1958 | Geiger, Sr. | 229/160.1 |
| 2,900,122 | 8/1959 | Steiner . | |
| 2,982,465 | 5/1961 | Fallert | 229/117.07 |
| 3,027,062 | 3/1962 | Huss et al. | 229/114 |
| 3,410,475 | 11/1968 | Wagner | 229/125.29 |
| 4,570,845 | 2/1986 | Hall | 229/153 |
| 4,657,176 | 4/1987 | Matsubara | 229/125.28 |
| 4,804,137 | 2/1989 | Harby | 229/114 |
| 4,809,908 | 3/1989 | Keefe et al. | 229/150 |
| 4,856,707 | 8/1989 | Lorenz | 229/114 |
| 4,877,178 | 10/1989 | Eisman | 229/114 |
| 4,960,238 | 10/1990 | Lorenz | 229/114 |
| 4,995,557 | 2/1991 | Fremion | 229/125.29 |
| 5,060,851 | 10/1991 | Lorenz | 229/901 |

*Primary Examiner*—Gary E. Elkins
*Attorney, Agent, or Firm*—Michael J. Doyle; Walt Thomas Zielinski

[57] ABSTRACT

A tray formed from a unitary paperboard blank. The tray has a locking tab at each corner, each latching tab projecting beyond the next adjacent tray wall. Two such trays may be latched together to form a closed container. The tray structure is such that two of the trays may be latched together in only one of four possible angular relations of the trays. The tray is rectangular and may be square or oblong.

12 Claims, 3 Drawing Sheets

LOCKING TRAYS

BACKGROUND OF THE INVENTION

This invention relates to containers and more particularly to containers for packaging food items such as frankfurters, hamburgers, or the like.

The container art is aware of tray-type containers for packaging of food items, the containers fashioned from paperboard or other stiff, foldable, and resilient sheet material. An example of known containers of the general type of this invention is seen in U.S. Pat. No. 4,856,707 issued to Lorenz. That construction exhibits the advantage of a tray which may be latched to another tray of identical construction to form a closed container, thus obviating the requirement that the bottom tray or bottom container be of a construction different from that of the top tray. While apparently satisfactory for the purpose intended, the Lorenz construction suffers the drawback that of the four possible ways of aligning the top tray to the bottom tray, two of these positions will result in forming a locked or complete container. This feature defeats those situations where it is desired that both the bottom and top be aligned in a desired, predetermined manner so that the graphics on both the bottom and top tray will be aligned. Because of the two possible ways of effecting locking of the Lorenz construction, the desired alignment of graphics is sometimes no realizable due to the fact that the operator placing the top tray on the bottom tray, with a food product therein, may inadvertently assemble the trays in misalignment vis-a-vis graphics.

Another and ever more important disadvantage of the Lorenz construction is that containers of that type are necessarily square, it not being possible to form oblong rectangular trays according to the Lorenz construction wherein both the top and bottom trays are identical and wherein the trays will interlock.

SUMMARY OF THE INVENTION

According to the practice of this invention, a paperboard tray construction yields trays fashioned from identical blanks and wherein a top tray may be placed on a bottom tray, if desired, to form a closed container. The trays of this invention may be either square or oblong rectangular. While paperboard represents the blank material employed for the best mode of practicing the invention, any other stiff, resilient, and foldable sheet material may be used.

DETAILED DESCRIPTION OF THE INVENTION

Figure 1:
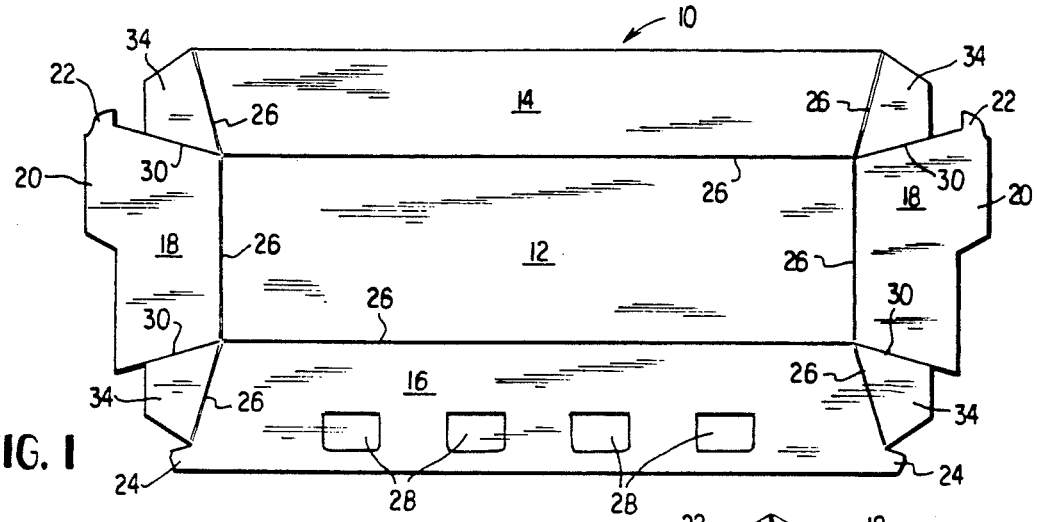
FIG. 1 is a blank from which a rectangular tray according to this invention is formed.

Referring to FIG. 1 of the drawings, 10 denotes unitary paperboard blank which may, optionally, be coated on one or both sides with a plastic film such as polyethylene or other FDA approved coating. The blank includes a bottom panel 12 bordered by fold lines 26. One longitudinal side of bottom panel 12 is foldably secured along fold line 26 to side panel 14. Lower portion of panel 12 (as viewed in FIG. 1) is foldably secured to another elongated side panel 16. It will be observed that panel 16 is wider than panel 14 (as measured in FIG. 1 in a vertical direction). The right and left ends of panel 12 each foldably carry an end wall forming panel 18, each of the latter including an extension 20, with extension 20 terminating at each upper end in a locking tip or tab 22. End walls 18 are of a dual width. The lowest edge of side panel 16 is provided with a similar locking tab 24 at each end. Side panel 16 may also be provided with a plurality of push tabs 28, each cut on three sides with the fourth side being a fold line. Such push tabs may be used to indicate the contents of the tray.

Cut lines 30 separate the end walls 18 from glue tabs 34, the latter attached to respective ends of side panels 14 and 16. Alternatively, the glue tabs may be integral with end walls 18, and corresponding fold lines 26 replaced with cut lines.

To form a tray from the blank of FIG. 1, the side and end panels are folded upwardly, with glued tabs 34 adhesively secured to the inside of respective end panels 18. The slant of the tray walls is less than 90 degrees.

Figure 2:
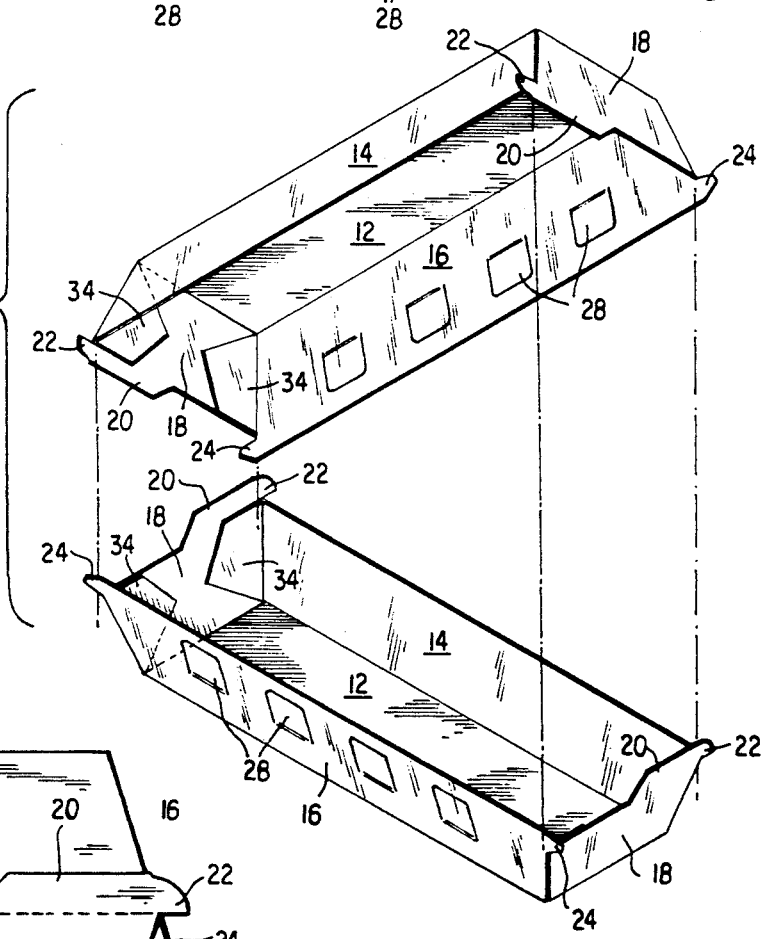
FIG. 2 is an exploded view illustrating the mode of assembly of two of trays shown at FIG. 1.
Figure 3:
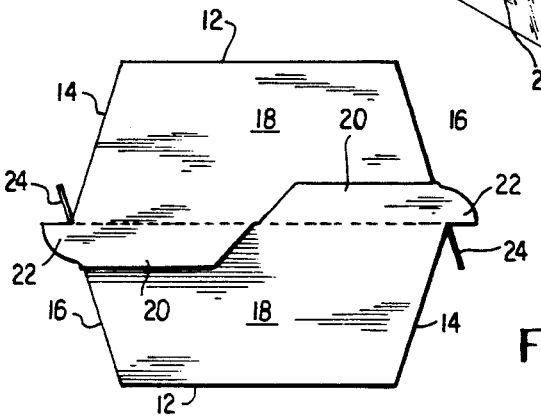
FIG. 3 is an end elevational view showing the trays of FIG. 2 when they are assembled and locked together.
Figure 4:
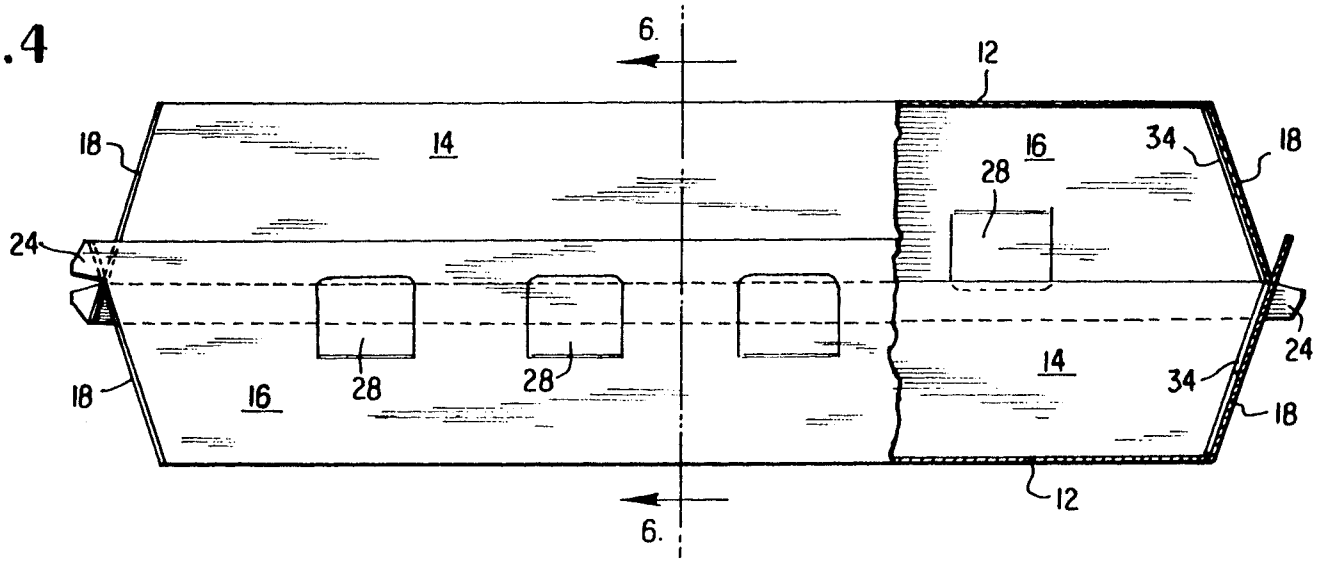
FIG. 4 is a side elevational view of the assembled trays of FIG. 2.
Figure 6:
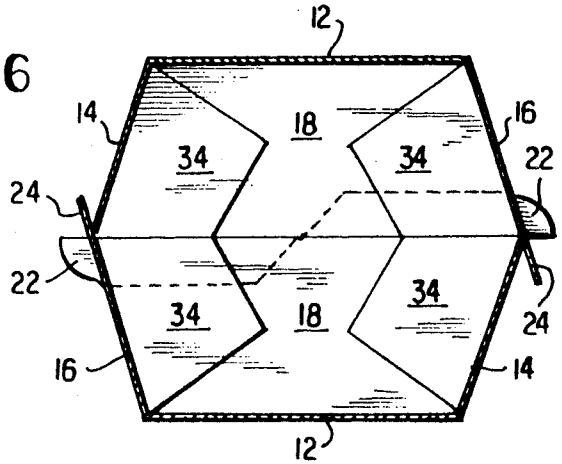
FIG. 6 is a view taken along section 6—6 of FIG. 4.
Figure 5:
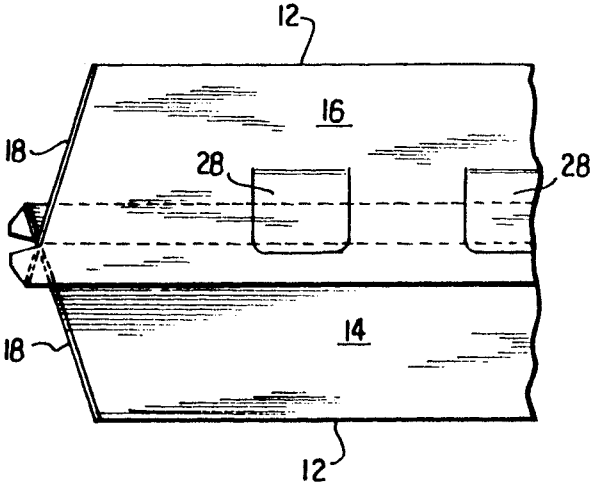
FIG. 5 is a partial view, similar to FIG. 4, showing the opposite side of the container of FIG. 4.

Referring now to FIG. 2, two of the trays are shown prior to interlocking them. A food item, such as a frankfurter sandwich, may be placed in the bottom tray and the top tray then moved down, so as to cause interlocking or latching between the locking tabs 22 and 24 of respective trays. Corresponding aligned pairs of latching tabs 22, 24 on the upper and lower trays are able to make contact with each other, bend, and then move back to effect latching pairwise interengagement due to the natural resiliency of paperboard.

FIGS. 3–6 further show the completed container construction. It will observed that locking tabs 24 engage with locking tabs 22, as shown at FIGS. 3–6 to thereby form a closed container with a food item (not illustrated) inside the container, thus protecting the food item from contamination and heat loss prior to its consumption. Unlatching of the tray halves is easily effected by manually bending the several locking tabs 22, 24, at one end or one side of the container. Bending for unlatching is made possible, again, by the natural resiliency of the paperboard.

It will be observed from a consideration of FIG. 2 for example that there is only one orientation of the top tray relative to the bottom tray which will permit locking engagement between the trays. This, as noted, facilitates the use of matching indicia or graphics on the side walls 14 and 16 as well as end walls 18 of the upper and lower trays.

Figure 7:
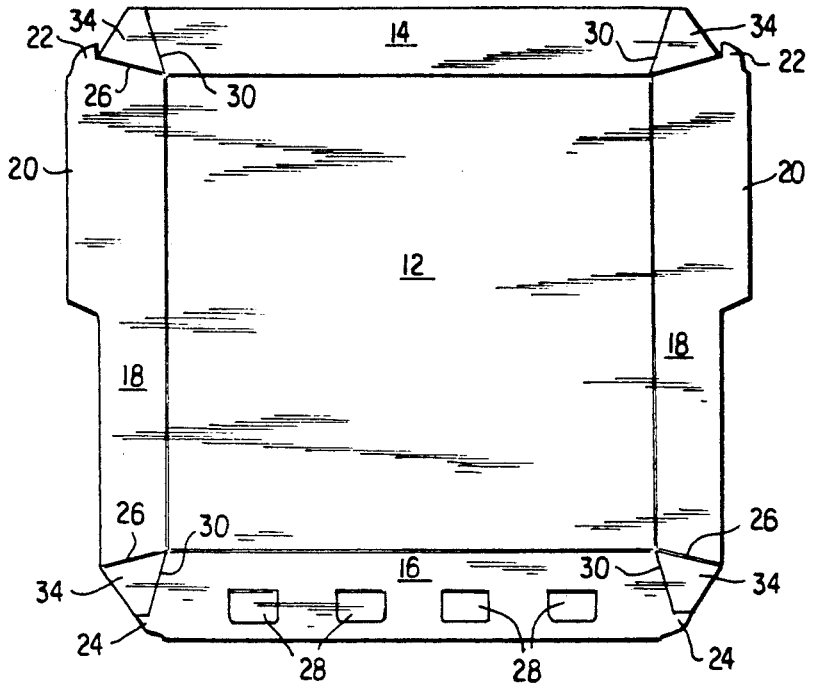
FIG. 7 is a blank, similar to the blank of FIG. 1, but square instead of rectangular.
Figure 8:
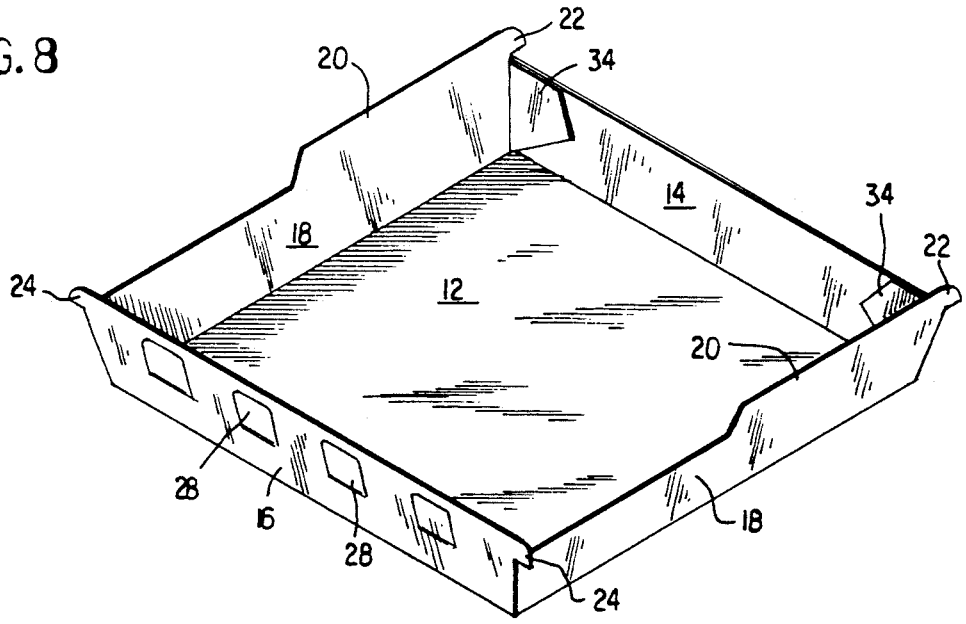
FIG. 8 is a perspective view of tray formed from the blank of FIG. 7.

Referring now to FIGS. 7 and 8 of the drawings, a modification is illustrated wherein the blank and tray formed therefrom are square. The same reference numerals are employed for corresponding elements in this second embodiment, Aside from differences in proportion (square as opposed to oblong) the only structural difference is that glue tabs 34 are foldably attached to end panels 18, instead of being attached to side panels 14 and 16.

In both embodiments it is seen that the narrower portions of end panels 18 are nearest the widest side panel 16, the latter carrying oppositely extending latching tabs 24. It is also seen that each latching tab 22, 24 projects beyond the plane of the next adjacent end or side wall. Various configurations may be given to the latching tabs to facilitate their passing together just prior to final interlocking.

I claim:

1. A unitary paperboard blank for forming a tray, the blank being cut and scored to yield cut and fold lines which define a plurality of panels, having free edges not connected to any other panel, the blank including a bottom panel, a pair of opposite sidewall panels, a pair of opposite endwall panels, one of said sidewall panels being wider than the other sidewall panel, the widest sidewall panels having a latching tab at each end thereof remote from the fold line joining said widest sidewall panel to said bottom panel, each endwall panel being of a dual width to define a wider and a narrower segment, that end of each wider segment of each said endwall panel having a latching tab remote from the fold line joining a respective endwall panel to said bottom panel, each said endwall latching tab projecting generally away from said wider sidewall panel, each said wider endwall segment being more remote from said wider sidewall panel than its respective narrowest segment.

2. The blank of claim 1 wherein the width of said narrowest sidewall panel is the same as the width of the narrowest segments of said endwall panels.

3. The blank of claim 1 including glue flaps foldably secured to the ends of one of the sidewall or endwall panels.

4. The blank of claim 1 wherein said blank is generally oblong rectangular.

5. The blank of claim 1 wherein said blank is generally square.

6. A paperboard tray having a bottom rectangular panel and walls, said walls including a pair of opposite, rectangular endwall panels extending upwardly from two opposite edges of the bottom panel, a pair of opposite, rectangular endwall panels extending upwardly from two other opposite edges of the bottom panel, one of sidewall panels being higher than the other sidewall panel and also having a pair of horizontal, outwardly projecting tabs at its ends, each of said endwall panels, having two sections of dual height, each of said endwall sections having the greater height having a horizontal tab at one of its upper ends, each latter said tab projecting in the same direction and away from said die panel having said horizontal, outwardly projecting tabs, these endwall panel sections having a lesser height being nearest to said sidewall having the greater height, whereby said tray is adapted to form a closed container by latching it to a tray of identical construction.

7. The tray of claim 6 wherein each of said tabs are coplanar with the respective panels from which they project.

8. The tray of claim 6 wherein each of said tabs project beyond the plane of a respective next adjacent tray wall.

9. The tray of claim 6 wherein said tray is oblong.

10. The tray of claim 6 wherein said tray is square.

11. The tray of claim 6 wherein the tray is formed from a unitary paperboard blank.

12. The tray of claim 11 including glue flaps at each corner of the tray.

* * * * *